United States Patent [19]

Hutton

[11] 4,386,760

[45] Jun. 7, 1983

[54] SELF-TAILING WINCH

[76] Inventor: Albert J. Hutton, 42 Kareela Rd., Baulkham Hills, N.S.W. 2153, Australia

[21] Appl. No.: 170,162

[22] Filed: Jul. 18, 1980

[51] Int. Cl.[3] ..... B66D 1/30; B66D 1/22

[52] U.S. Cl. ..... 254/371; 226/193; 254/344

[58] Field of Search ..... 254/371, 342, 295, 344; 226/190, 193

[56] References Cited

U.S. PATENT DOCUMENTS

| | | | |
|---|---|---|---|
| 3,934,482 | 1/1976 | Byers | 254/371 |
| 3,985,340 | 10/1976 | Guangorena | 254/371 |
| 4,093,185 | 6/1978 | Newell | 254/295 |
| 4,151,980 | 5/1979 | Burton et al. | 254/371 |
| 4,230,306 | 10/1980 | Porter | 254/371 |

*Primary Examiner*—Billy S. Taylor

*Attorney, Agent, or Firm*—Stevens, Davis, Miller & Mosher

[57] ABSTRACT

A self-tailing winch for use on a sailboat comprising a rotatable drum and a clamping pulley attached to and axially aligned with the upper end of the drum. The pulley has a rigid upper jaw and a flexible lower jaw formed from elastomeric material. There is a recess under the material of the lower jaw to permit it to flex into the recess and at least partially close it so as to afford an additional degree of flexibility to the lower jaw.

2 Claims, 6 Drawing Figures

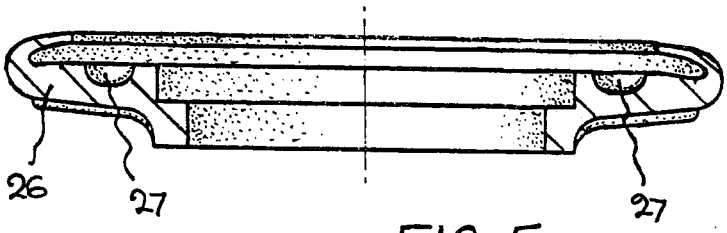
FIG. 5
FIG. 6
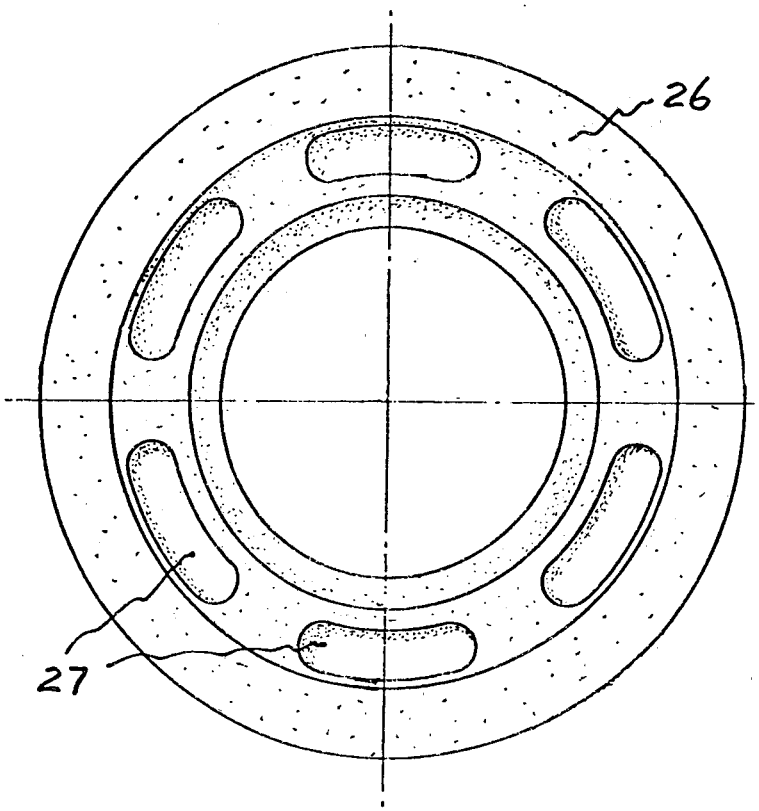

SELF-TAILING WINCH

This invention relates to winches, and more particularly to marine winches of the kind used to manipulate the sheets of sails or the like.

It is known to construct marine winches having variable rotation speeds and in which, for example, a reduction gear is located so that a handle turned by an operator gives a desired speed to a drum which is connected to said reduction gear.

It is a problem, when winding in a sheet with the aid of such a drum, to be able to cleat said sheet (i.e. hold it) and also to be able to ease it as it comes off the drum, which is meanwhile being wound by said handle.

Attempts have been made to solve this problem simply by having, in addition to the operator of the handle, an extra operator who secures and hauls in the spare end of the sheet and who, if necessary, cleats it so as to prevent it from sliding back around the drum, especially at those times when extra strain is put upon the sheet due to an increase in load imparted, for example, by a sail.

However, it is clearly a disadvantage to employ two operators to control the same winch, especially on board a racing yacht or the like, where the weight factor is critical.

It is an object of the present invention to overcome the above and other disadvantages, and to provide a self-tailing, self-cleating winch which is capable of operation by a sole operator.

In accordance with the invention therefore, in one of its aspects, a self-tailing winch for a sheet comprises in combination a stationary frame, a rotatable input shaft supported by said frame, a rotatable drum supported by said frame, a reduction gear train connecting said input shaft to said drum so that said drum is driven by said shaft, a clamping pulley attached to and axially aligned with the upper end of said drum for rotation therewith, said pulley comprising a rigid upper jaw co-acting with a flexible lower jaw formed from elastomeric material, said jaws each having inner annular surfaces defining an annular groove between them, whereby said groove defines a constant winding diameter for said sheet, said groove having an effective root diameter substantially less than the winding diameter of said drum, a stationary member anchored to said frame on top of said pulley, sheet deflector means supported by said stationary member and adapted to feed a sheet from said drum to said groove, and an annular recess lying in said stationary frame and axially juxtaposed below said lower jaw to thereby permit flexure of said lower jaw into said recess, at least in part, in response to the temporary jamming of a sheet within said groove when said sheet is of a size greater than that of a sheet otherwise grippable frictionally without said flexure of said lower jaw.

Certain embodiments of the invention defined in the preceding paragraph will now be described herein with reference to the accompanying drawings, in which similar references indicate corresponding parts, and in which:

FIGS. 5 and 6 show the apparatus of FIG. 4 in side elevation and plan view from below, respectively.

Figure 1:
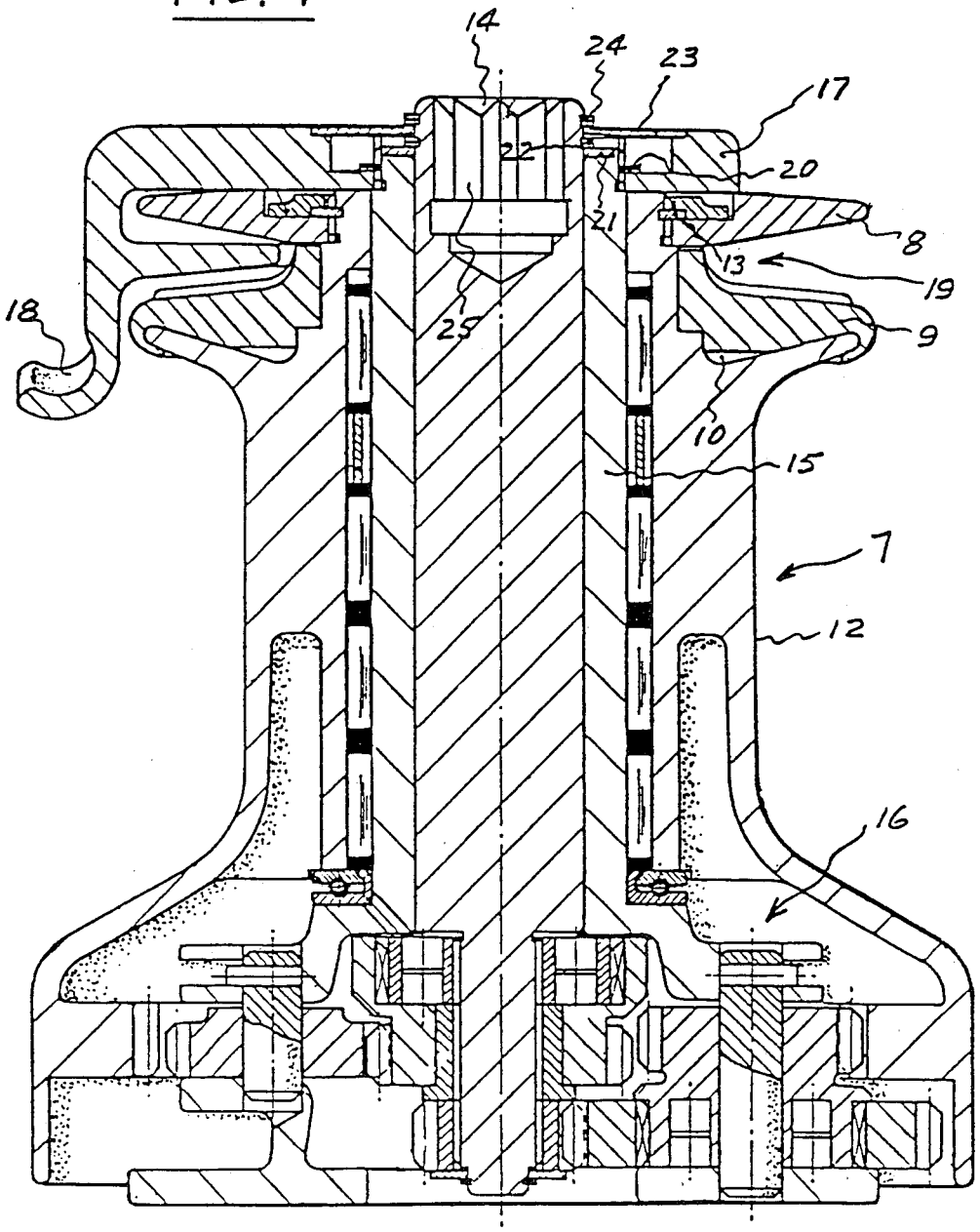
FIG. 1 shows, in elevation, a section through an assembled winch.
Figure 2:
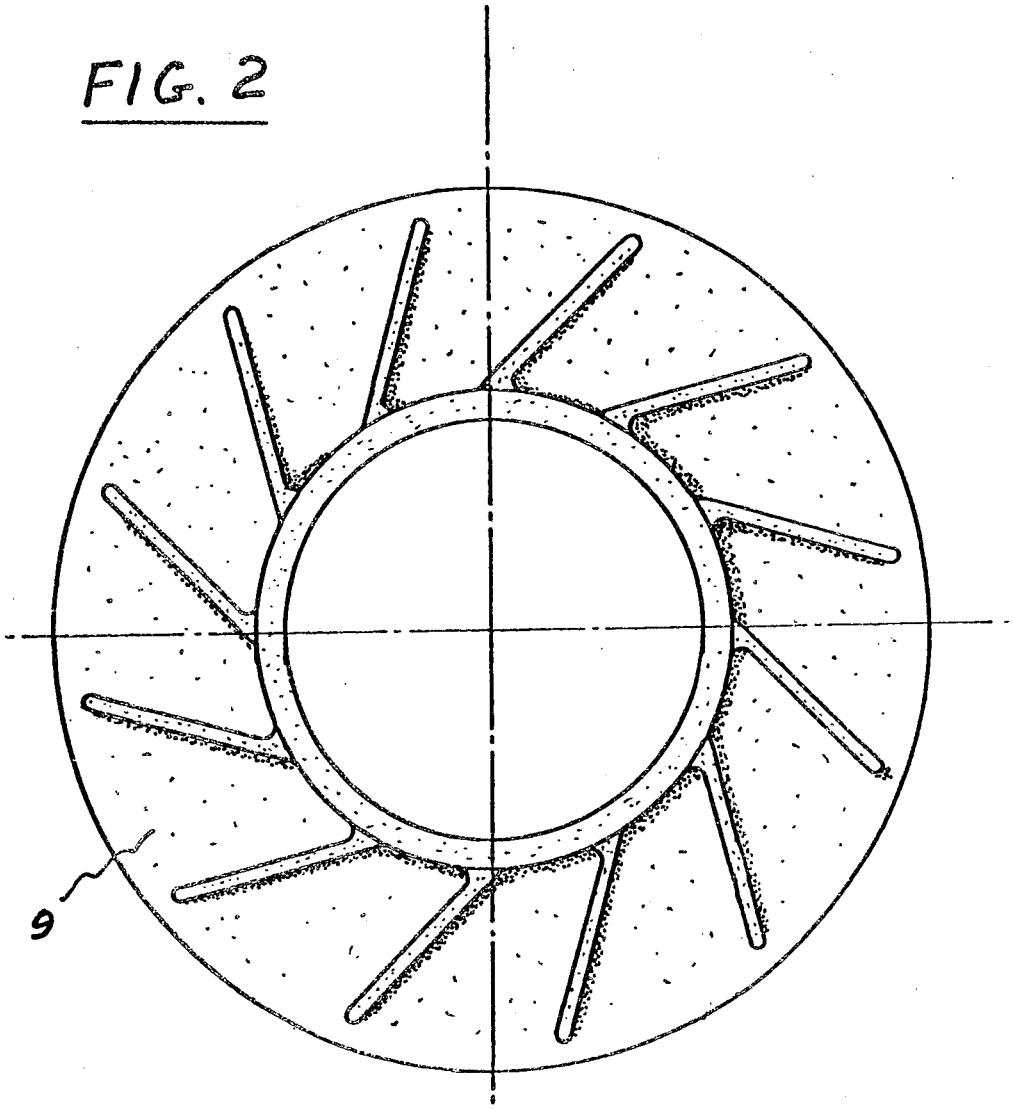
FIG. 2 shows, in plan view from above, a flexible lower jaw.
Figure 3:
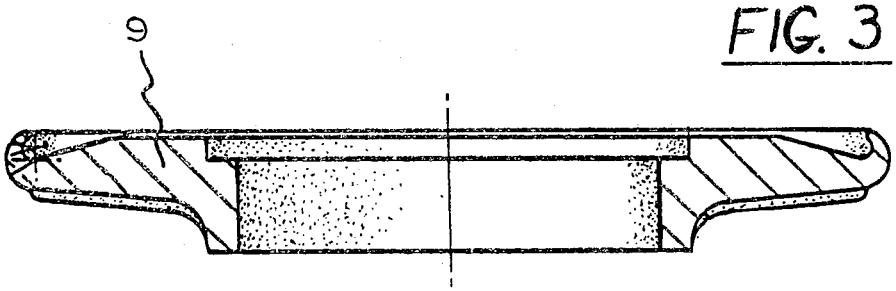
FIG. 3 shows the apparatus of FIG. 2 in side elevation.

Upon referring to FIGS. 1 to 3 of the drawings it will be seen that a winch 7 of generally known configuration has a rigid upper jaw 8 and a flexible lower jaw 9, which contacts the upper outer end surface of the rim of drum 12, the contact area being on a radially outer annular area of the rim as clearly shown in FIG. 1. The flexible jaw 9 is formed from suitable material such as hard rubber, polystyrene or NEOPRENE, having sufficient resilience to permit it to be forced into the recess 10 completely under the influence of a sheet of large diameter, but nevertheless having sufficient strength or stiffness to be self-supporting so as to form the lower part of an effective pulley when co-acting with said rigid upper jaw 8, which latter may be formed from steel or other material from which the drum 12 itself is formed, to thereby permit the frictional retention of sheets of relatively smaller diameter. Said elastomeric material is preferably of a kind which resists the absorption of water, and which is substantially unaffected by ultraviolet radiation.

Said recess 10 may be circumferentially continuous and simply machined out from the top surface of a standard drum 12 of the kind often employed in marine winches. Preferably, both said jaws are assembled with respect to the drum 12 without the use of discrete fastenings such as screws, nuts or bolts. This is achieved by springing the re-entrant periphery of the jaw 9 about the upper rim of the drum and then slipping a suitable circlip such as 13 into an undercut which is machined in the frame opposite the jaw 8.

The input shaft 14 is solid, and is surrounded fittingly by a co-axial hollow shaft 15. The lower end of said hollow shaft 15 is attached to a reduction gear train shown generally at 16, and the upper end is attached in any suitable way, such as via a spline, in the same manner as the top jaw 8, to ensure that the supporting means 17 mounted over the top of the winch to support the deflector means 18 does not turn in unison with the drum 12 and its associated "pulley". Said deflector means 18 may comprise a rigid finger which depends, as shown, over the side of the pulley to a region just below the lower jaw 9, in which position it may direct the sheet as it emerges from the top of the drum 12 into said pulley groove indicated at 19.

The supporting means 17 may then have a suitable circlip 20 installed to retain the assembly in position. A washer 21 may then be placed over the top end of the hollow shaft 15, and held in place by a circlip 22. A main plate 23 may then be located over said assembly, and held in position by a circlip 24. The main plate thus covers all but the protruding input shaft 14, which is adapted to be turned by means of a removable handle (not shown) having a suitable boss which removably engages the spline 25.

It will be seen that the above-described arrangement permits a sheet to pass from the upper end of the drum via said finger 18, and into said groove 19 at a substantially constant speed ensured by the ratio of diameters of said drum exterior surface and that of the groove interior or root. Thus, no undue differential forces are imparted to the sheet during cleating. Furthermore, the invention permits the ready adaption of the winch to a wide range of sheet sizes, owing to the self-adjusting property of the pulley. That is to say, the rubber or other material of the lower jaw 9 compresses under the force imparted by a larger sheet and thus an initially soft action is available for gripping smaller sheets, followed by an instant harder action of the apparatus when larger sheets are to be gripped. Self-tailing may be carried out in the normal manner, owing to the ease with which the sheet can be plucked from the groove as required.

Figure 4:
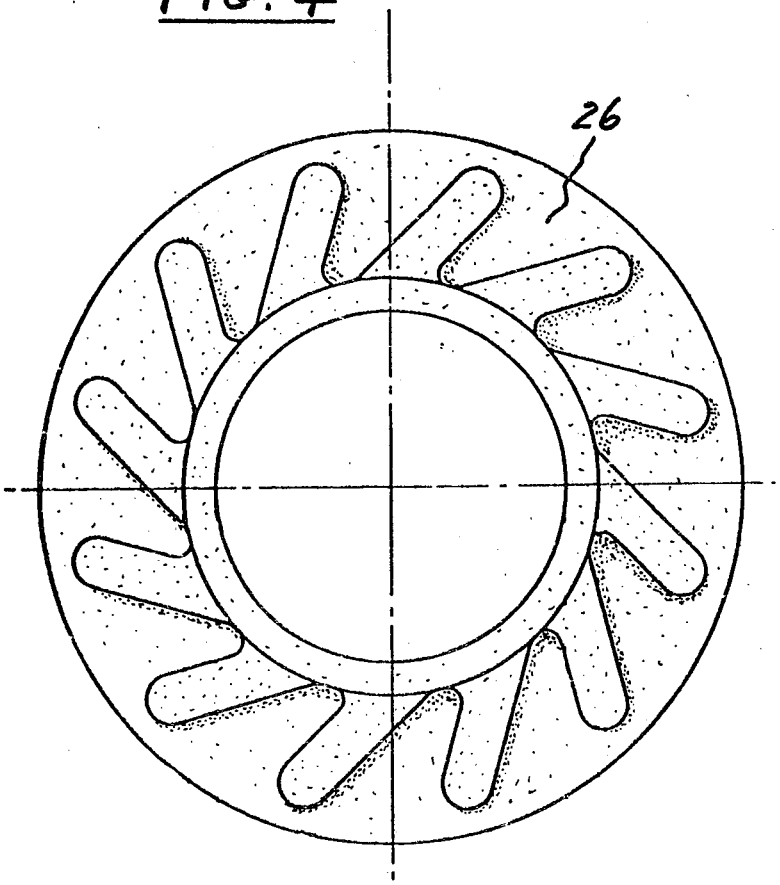
FIG. 4 shows, in plan view from above, a modified form of said flexible lower jaw.

In a modification of the invention, shown in FIGS. 4, 5 and 6, the lower jaw 9 of the first embodiment is replaced by the lower jaw 26 which is itself provided upon its lower face with a series of circumferentially equally spaced recesses such as 27, preferably preformed by moulding during the manufacture of the jaw 26, which is thus simply a ring-like device which rests upon the upper outer end of the drum 12, said upper end thus requiring only a plane surface, which needs no machining after casting, since the existence of the erstwhile recess 10 is now unnecessary, although a mechanically equivalent structure is provided.

It has been found, in tests leading to the present invention, in either of its embodiments, that a major advantage thereof is the low rate of wear of the sheet or rope used therewith, in comparison with prior known systems such as those incorporating pairs of flexible jaws, or pairs of rigid jaws spaced apart by various resilient means. Even after prolonged use, of the order of 1 to 2 years, when some wear of the NEOPRENE or similar material of the present invention's lower jaw could be expected, it is a simple matter to remove temporarily the winch's top jaw and replace said lower jaw at very low cost.

Furthermore, it will be appreciated that it is not necessary to remove said top jaw and insert washers at the root of the groove to enable the pulley to grip thicker sheets or ropes, as in various prior known systems. On the contrary, a useful range of sheet sizes may be gripped by the pulley simply by virtue of the flexure of the lower jaw so as to close the recess 10 or the recesses 27 as the case may be.

The claims defining the invention are as follows:

1. A self-tailing winch for a sheet comprising in combination a stationary frame; a rotatable input shaft supported by said frame; an upstanding rotatable drum supported by said frame; a radially outwardly extending rim adjacent the top of said drum, said rim having an upper outer end surface which is angled upwardly at an acute angle to the drum axis; a reduction gear train connecting said input shaft to said drum so that said drum is driven by said shaft; a clamping pulley attached to and axially aligned with the upper end of said drum for rotation therewith, said pulley comprising a rigid upper jaw and a flexible radially extending lower jaw formed from elastomeric material, said material contacting the upper outer end surface of said rim over a radially outwardly area thereof and gradually increasing in thickness radially inwardly from that area of contact, said thickness increase being to a lesser extent than the angle of the rim to thus define a recess between the underside of the elastomer material and the upper end surface of said rim, said recess being radially inward of the area of contact between the elastomer material and the rim; said jaws each having inner annular surfaces defining an annular groove between them, whereby said groove defines a constant winding diameter for said sheet, said groove having an effective root diameter substantially less than the winding diameter of said drum, a stationary member anchored to said frame on top of said pulley, sheet deflector means supported by said stationary member and adapted to feed a sheet from said drum to said groove, said recess permitting flexure of said lower jaw by closing said recess, at least in part, in response to the temporary jamming of a sheet within said groove when said sheet is of a size greater than that of a sheet otherwise grippable within said groove frictionally without said flexure of said lower jaw.

2. The winch of claim 1 in which the elastomeric material of the lower jaw extends radially outwardly of said annular area of contact and down over the outer periphery of said rim.

* * * * *